US007143692B2

(12) United States Patent
Schmitt et al.

(10) Patent No.: US 7,143,692 B2
(45) Date of Patent: Dec. 5, 2006

(54) DEVICE FOR PRODUCING FOLDED PRODUCTS

(75) Inventors: Patrick Otmar Schmitt, Rittershausen (DE); Stefan Wander, Helmstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 106 days.

(21) Appl. No.: 10/498,355

(22) PCT Filed: Dec. 17, 2002

(86) PCT No.: PCT/DE02/04611

§ 371 (c)(1),
(2), (4) Date: Jun. 18, 2004

(87) PCT Pub. No.: WO03/055777

PCT Pub. Date: Jul. 10, 2003

(65) Prior Publication Data

US 2005/0093221 A1 May 5, 2005

(30) Foreign Application Priority Data

Dec. 21, 2001 (DE) ..... 101 63 211

(51) Int. Cl.
*B41F 13/56* (2006.01)

(52) U.S. Cl. ..... 101/227; 101/219

(58) Field of Classification Search ..... 101/227, 101/226, 219, 216, 224, 212; 270/4, 5.01, 270/10, 16, 20.1, 21

See application file for complete search history.

(56) References Cited

U.S. PATENT DOCUMENTS

| | | | | |
|---|---|---|---|---|
| 3,942,782 | A | 3/1976 | Hermach | 270/6 |
| 4,538,517 | A | 9/1985 | Michalik et al. | 101/277 |
| 4,671,501 | A | 6/1987 | Fujishiro | 425/127 |
| 5,176,371 | A * | 1/1993 | Rau et al. | 270/42 |
| 5,303,909 | A | 4/1994 | Maylaender | 270/5.01 |
| 6,024,684 | A * | 2/2000 | Maylander et al. | 493/346 |
| 6,298,781 | B1 * | 10/2001 | Dufour | 101/483 |
| 6,408,748 | B1 | 6/2002 | Hajek et al. | 101/177 |
| 6,588,739 | B1 * | 7/2003 | Weis | 270/6 |
| 6,644,184 | B1 | 11/2003 | Hajek et al. | 101/177 |
| 2003/0066444 | A1 | 4/2003 | Hajek et al. | 101/217 |

FOREIGN PATENT DOCUMENTS

| | | |
|---|---|---|
| DE | 25 10 057 | 9/1975 |
| DE | 32 37 504 A1 | 4/1984 |
| DE | 41 28 797 A1 | 3/1993 |
| DE | 41 37 818 A1 | 5/1993 |
| DE | 44 30 693 A1 | 3/1996 |

* cited by examiner

*Primary Examiner*—Anthony H. Nguyen
(74) *Attorney, Agent, or Firm*—JonesTullar&Cooper, P.C.

(57) ABSTRACT

A device for providing folded products utilizes a funnel-shaped structure that consists of at least two funnels that are usable for providing two longitudinally folded strands or webs. A register device is usable for adjusting a path of at least one of the strands or webs between the funnel and the entrance to a folding machine. The register device can be associated with both of the strands or webs.

15 Claims, 3 Drawing Sheets

DEVICE FOR PRODUCING FOLDED PRODUCTS

CROSS-REFERENCE TO RELATED APPLICATIONS

The subject application is the U.S. National Phase of PCT/DE02/04611, filed Dec. 17, 2003; published as WO 03/055777 A1 on Jul. 10, 2003 and claiming priority to DE 101 53 211.8, filed Dec. 21, 2001.

FIELD OF THE INVENTION

The present invention is directed to a device for making folded products. A folding hopper structure has at least two folding hoppers for producing at least two longitudinally folded strands.

BACKGROUND OF THE INVENTION

A hopper structure for a double-width printing press is known from DE 32 37 504 A1. Longitudinally folded strands from two hoppers, which are arranged side-by-side, can be selectively conducted to one of two folders arranged underneath them. Alternatively, each strand can be conducted to either one of the two folders.

A hopper structure for a triple-width printing press is known from DE 25 10 057 A1, which hopper structure has three upper hoppers and three lower hoppers, each arranged side-by-side. The strands run over guide rollers and a dancer roller assigned to the respective strand, by use of which rollers each strand'linear register can be set before they are conducted together to a gap of the folder.

DE 41 28 797 C2 shows an arrangement of several hoppers for the longitudinal folding of strands of paper webs. The folded strands can be selectively conducted to a first folder, to a second folder, or to both folders arranged underneath.

A folding structure is known from DE 44 30 693 A1. Folded strands can be conducted by hoppers, via individually motor-driven traction and transfer rollers, to two folders which are individually motor-driven.

DE 41 37 818 A1 discloses a hopper structure with at least two side-by-side arranged hoppers. Traction rollers, each with an rpm-adjustable drive mechanism, are provided for adjusting the tension in the strands leaving the hoppers.

SUMMARY OF THE INVENTION

The object of the present invention is directed to providing a device for making folded products.

In accordance with the present invention, the object is attained by the provision of a hopper structure having at least two hoppers, or funnels, for producing at least two longitudinally formed and then folded strands. At least one register device may be provided for establishing a path of at least one of the strands between the hoppers and an entry into a folder. The hoppers, subsequent folding rollers and subsequent folders are arranged on different levels.

The advantages to be gained by the present invention lie, in particular, in that a great flexibility in the products of a printing press is created. Additionally, the outlay and the costs in regard to the guidance and register regulation of individual strands are kept low.

In an advantageous embodiment of the present invention, the tracks and direction changes of the strands are kept low and comparable for all strands. This in turn, favors the reduction of regulation and an improvement of the product quality.

BRIEF DESCRIPTION OF THE DRAWINGS

A preferred embodiment of the device for producing folded products, in accordance with the present invention, is represented in the drawings and will be described in greater detail in what follows.

Shown are in.

DESCRIPTION OF THE PREFERRED EMBODIMENTS

A printing press, and in particular a web-fed rotary printing press, has one or several printing groups or printing units, which are not specifically represented, and by the use of which, at least one web 01 of material to be imprinted, hereinafter web 01 for short, can be imprinted. The printing units are embodied to be "double wide", for example. This means that the printing cylinders have a length which corresponds to at least four printed pages, for example newspaper pages in Rhenic, Berlin, New York Times format, or the like, or to eight horizontal pages in tabloid format, for example, such as pages of a telephone directory, for example.

Figure 1:
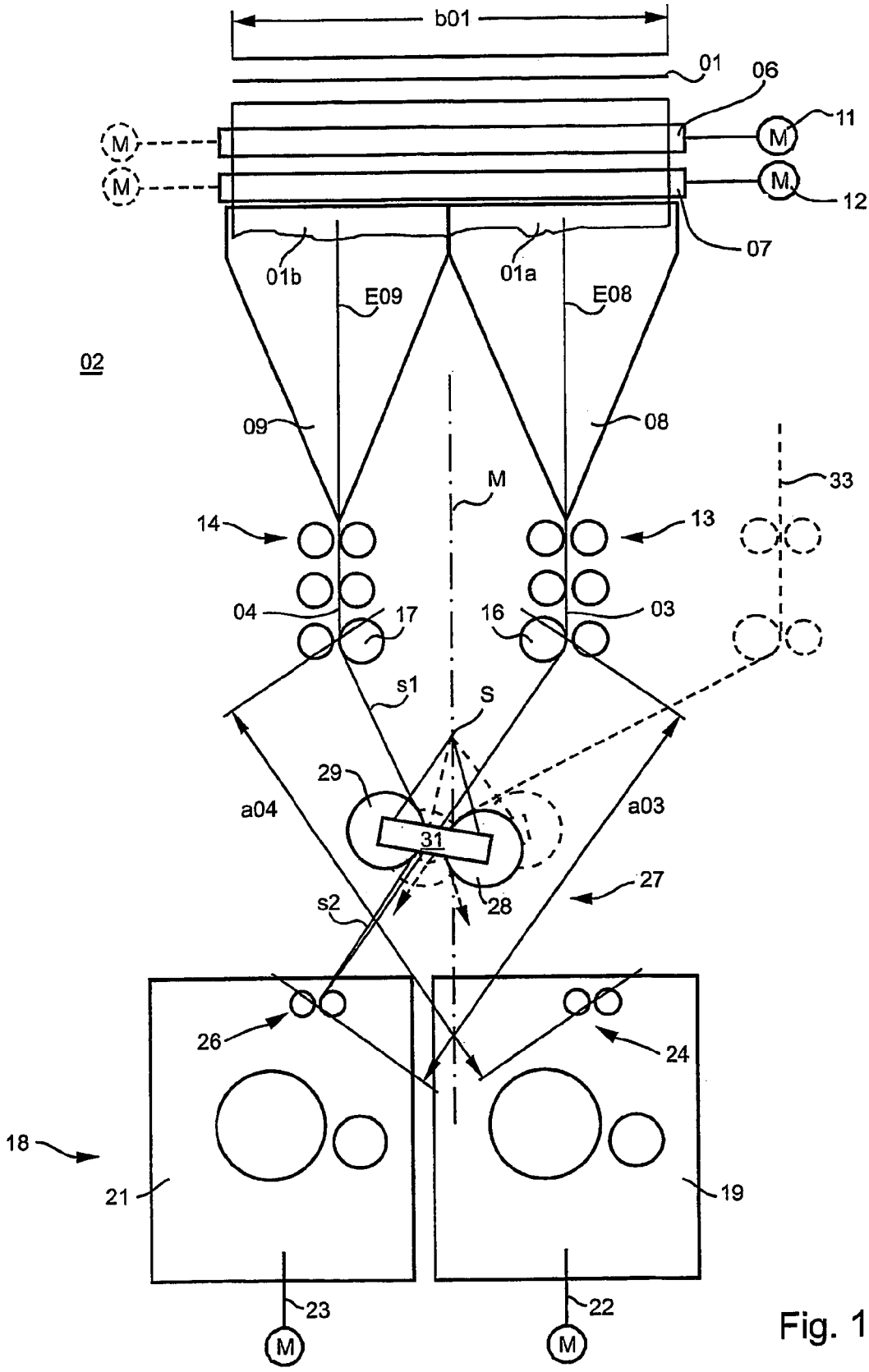
FIG. 1, a first preferred embodiment of a device for making folded products in accordance with the present invention, in FIG. 2, a second preferred embodiment of a device for making folded products, in FIG. 3, an alternative embodiment of the first preferred embodiment, and in FIG. 4, an alternative embodiment of the second preferred embodiment.

After the double-width web 01, or after the double-width web 01, depicted in FIG. 1, i.e. after four printed pages, of a width b01, of the web 01, have been imprinted in the printing units, they are conveyed to a hopper structure 02 for further processing. On the way to hopper structure 02, they are cut, in the longitudinal direction, into two partial webs 01*a*, 01*b* by a cutting device, which is not specifically represented, and are combined respectively into a web strand 03 or 04. Three cutting devices can also be arranged for printing in tabloid format, which three cutting devices cut the webs 01 longitudinally into quarters and into a corresponding number of web strands. In FIG. 1 combining the webs 01 into the web strand 03, 04 takes place by the use of a separate roller 06, or a group of rollers 06, before the strand 03, 04 is afterwards conducted via a roller 07, for example via a hopper roller 07, to respective hoppers or funnels 08, 09, for example embodied as so-called double hoppers or funnels 08, 09. The hoppers 08, 09 are preferably each arranged aligned with the one of respective partial web 01*a*, 01*b*. During so-called "straight forward operations" the partial webs 01*a*, 01*b* run up on the respective hoppers 08, 09 without an offset. In an advantageous embodiment, the web combining roller 06 and the hopper roller 07 each have their own drive motors 11, 12, by the use of which separate roller drive motors 11, 12 the web tension can be set or adjusted. In a further development, the web combining roller 06 and/or the hopper roller 07 can be embodied as rollers 06, 07 which are divided over their length into partial roller elements, and each such partial roller element can be driven by its own drive motor 11, 12, each represented twice in dashed lines in FIG. 1. Also, respectively two partial rollers 06, 07, not having a common core, can be arranged with their end faces or fronts directed toward each other, and each can be driven independently of the other by the use of their own drive motor 11, 12.

At least one pair of rollers 13, 14, which may be, for example, folding rollers 13, 14, and at least one traction roller 16, 17 are arranged downstream of each hopper 08, 09, respectively. In the first preferred embodiment depicted in FIG. 1, a pair of folding rollers 13, 14 and two traction roller groups 16, 17, for example one traction roller with contact rollers or contact cylinders acting together, are respectively, arranged downstream of each hopper 08, 09. The last traction roller group 16, 17, which constitutes a traction roller group nip 16, 17, is the structural termination of the respective folding or forming hopper or funnel 08, 09, in a running direction of the respective strand 03, 04 in the direction toward a folding unit 18, and, as a rule, this traction roller group nip is arranged at a fixed distance from the hopper 08, 09, except for any possible adjusting or mounting purposes.

The folding unit 18 is arranged downstream of the hopper structure 02 and has two folders 19, 21, or two folding groups 19, 21 of a double folder. In an advantageous embodiment of the present invention, the hoppers 08, 09 and the folders 19, 21 are arranged on directly adjoining feed levels, so that they are without any further intervening units, which intervening units would interfere with, or would extend the course of the web, such further units typically being configured as further hoppers, etc. In an advantageous embodiment, and as schematically represented in FIG. 1, the two folders 19, 21 each have their own drive motors 22, 23. The two strands 03, 04 can be fed selectively together to one of the folders 19, 21, or respectively each individually to one of the folders 19, 21.

The two folders 19, 21 are advantageously aligned, in respect to each other and to the two hoppers 08, 09, in such a way that the strands 03, 04 can be fed to the two folders 19, 21 over the shortest possible distance.

A first reference point 24, 26, for example a first folder nip 24, 26, which is represented in FIG. 1 by a roller group 24, 26 and which is a fixed part of the folder 19, 21, is assigned to each folder 19, 21, and acts together with the strands 03, 04, or the strands 03, 04. In an advantageous embodiment of the present invention, the two folders 19, 21 are embodied, or are arranged, in such a way that an uninterrupted path of the strand 03, 04 from the respectively last traction roller nip 16, 17 of the hoppers 08, 09 to the first folder nip 26, 24 of the folder 21, 29, which are arranged in the shape of a cross underneath, is substantially of the same length in each case. This means that a distance a03, a04 from the traction roller nip 16, 17 of the hopper 08, 09 is configured to be approximately equal to a distance a04, a03 from the traction roller nip 17, 16 of the hopper 09, 08 to the first folder nip 24, 26 of the folder 19, 21. The distances a04, a03 can differ from each other maximally by 200 mm, however preferably by 100 mm, in particular by up to 50 mm.

The two folders 19, 21 are, for example, arranged in such a way that each of the first folder nips 24, 26 is located symmetrically, with respect to a center plane M extending between the two hoppers 08, 09. The center plane M is located parallel to, and centered between the two planes which extend through the longitudinally folded strands 03, 04 in the area of the last folding rollers 13, 14, or in the area of the traction rollers 16, 17 assigned to the hoppers 08, 09. As a rule, these latter planes coincide with the symmetry planes E08, E09 of the hoppers 08, 09, such as represented in FIG. 1.

For rerouting the paths, or for setting the paths to be travelled by the two strands 03, 04 between the hoppers 08, 09 and the folders 19, 21, at least one register device 27 is provided. A position of the at least one register device 27 can be changed and this at least one register device 27 is assigned to the two strands 03, 04. The movement of a positional change of register device 27 has at least one component which is parallel in respect to the normal plane of the strands 03, 04 acting together in the area where they touch. In an advantageous embodiment, the register device 27 can be rotatorily driven by its own drive motor, which is not specifically represented, and its position can be changed by the use of an actuating drive, which also is not specifically represented. For example, the register device 27 can be pivotable along a curved line around a pivot axis S, or can be movable in the vertical direction. Depending on its position, the register device 27 acts in different ways with the strands 03, 04, which different ways of register device 27 action will be explained in greater detail in what follows.

In a first mode of operation of the device for producing folded products in accordance with the present invention, it is intended to produce a product in which the web strands 03, 04 of both hoppers 08, 09 are conducted to one of the two folders 19, 21. This one of the folders is the folder 21, as is shown in FIG. 1. The register device 27, which is common to both strands 03, 04, has now been pivoted or shifted about its pivot axis S in such a way that a total path to be travelled by the strand 04 between the traction roller nip 17 and the first folder nip 26 corresponds to a total path to be travelled by the strand 03 between the nips 16 and 26.

In an advantageous embodiment of the present invention, the register device 27 acts together selectively only with one strand 04, 03, here the strand 04, while the other strand 03, 04 runs undisturbed through the register unit 27, i.e. runs through the register unit 27 without an operative connection with the register unit 27. In this mode of operation, a resultant path S04, which is composed of the partial paths s1, s2, of the strand 04 has a distance which corresponds to the distance a03, all as seen in FIG. 1.

If now, in a second mode of operation, in which production is to take place on the other folder 19, the register device 27, which is assigned to the two strands 03, 04, is brought into a second position in which second position, the conditions of the running of the strands 03, 04, which prevail, are reversed with respect to the first mode of operation discussed above. Again, the paths S03, S04 are of the same length. For example, the strand 04 now extends without an operative connection with the register device 27. For reasons of clarity, the paths for the second mode of operation are not specifically represented in FIG. 1. Only the register unit 27 is indicated in FIG. 1 in dashed lines in its second position.

In the first preferred embodiment, which is shown in FIG. 1, the register device 27 has two rollers 28, 29, for example two register rollers 28, 29, which are arranged so that their positions can be changed together. In a simple embodiment, these two register rollers 28, 29 are arranged with their axes of rotation at a fixed distance from each other. If they are rotatorily driven by a drive mechanism, for example by a common drive motor, the drive mechanism should be configured in such a way that there is a direction of rotation in opposite directions. However, the two register rollers 28, 29 can also each be driven by their own separate drive motors. In FIG. 1, the two register rollers 28, 29 are arranged in a common support 31, or frame 31, which common support 31 or frame 31 is pivotable around the pivot axis S, which is fixed in respect to the frame and which extends in a plane parallel in respect to one of the folded strands 03, 04, and vertically in respect to its conveying direction. In an advantageous embodiment, because it is symmetrical, the pivot axis S is also arranged lying in the center plane M. The register device 27 is shown magnified or enlarged in FIG. 1.

In the mode of operation which is shown in solid lines in FIG. 1, the register roller 29 close to the hopper 09 acts together with the strand 04 in the above described manner. A distance "a", as is seen in FIG. 3, between the two register rollers 28, 29 has been selected, for example, in such a way that, taking into consideration the required pivot path, the register roller 28, 29 assigned to the other strand 03 is not in operative connection with that other strand 03.

Figure 2:
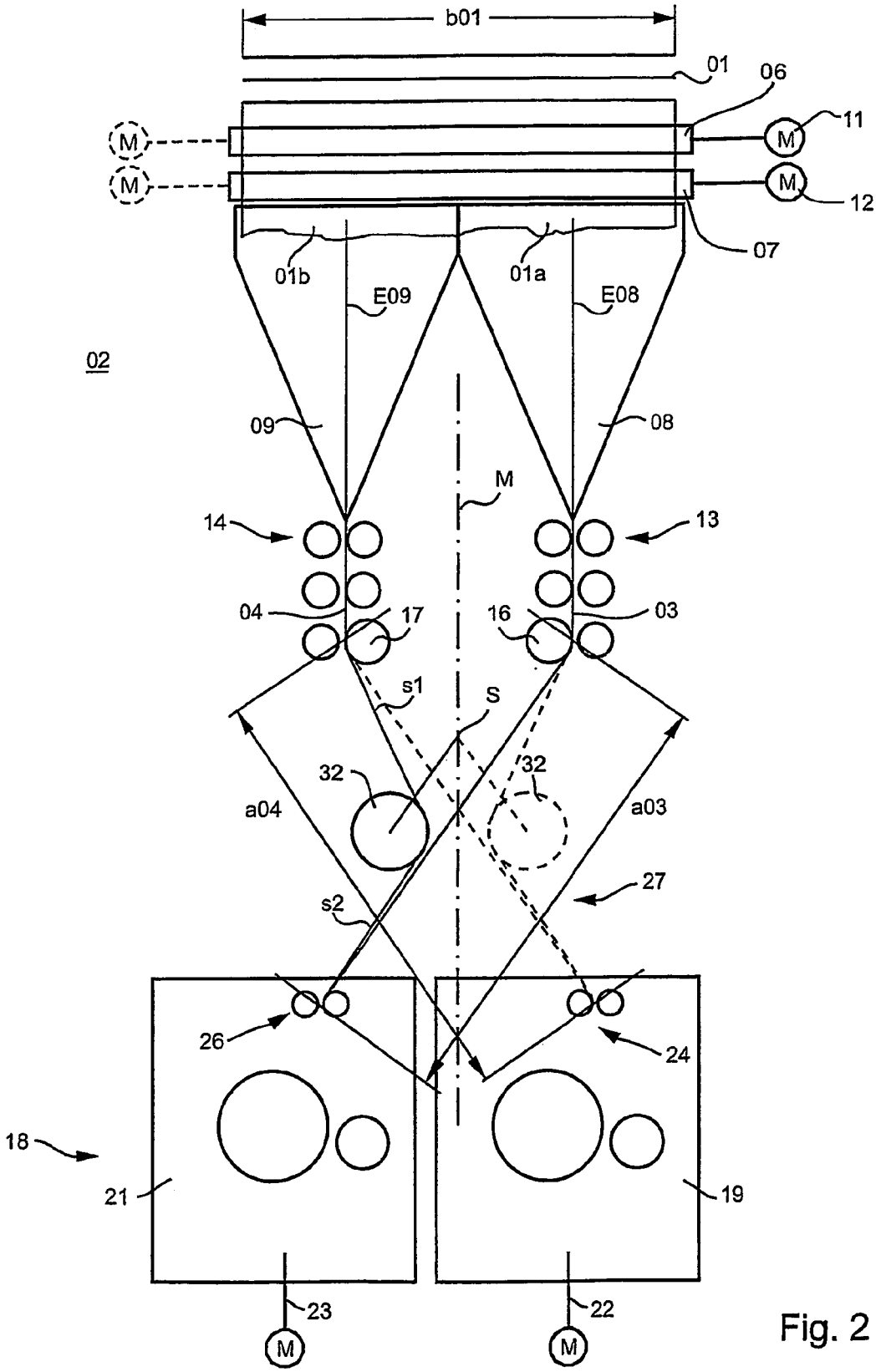

In a second mode of operation, as shown in FIG. 2, the register device 27 only has a single roller 32, for example a single register roller 32, which selectively acts together with only one of the two strands 03, 04 in the manner described above with respect to the paths S03, S04. In the first mode of operation, the register roller 32 acts together with the strand 04, as represented in solid lines in FIG. 2. Here, the single register roller 32 is not located between the two strands 03, 04, but is located on the side of the strand 04 to be rerouted, which side of strand 04 faces away from the other strand 03. The second mode of operation is again represented by a depiction of the single register roller 32 in dashed lines. The conditions regarding the path of the web and the position regarding the register roller 32 are symmetrical to or a mirror image of those from the first mode of operation of the register device shown in FIG. 2. If the roller 32 is embodied as a driven roller, for example by being driven through a gear from other units, or by its own rotatory drive motor, the drive mechanism should be provided as having an option for reversing the direction of rotation.

In a third mode of operation of this second embodiment, the register roller 32 can be in a position without contact with either one of the two strands 03, 04. Now production can take place with both strands 03, 04 each on one of the folders 19, 21 respectively.

Figure 3:
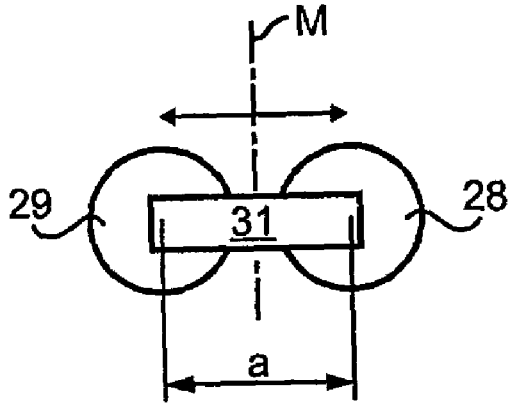
Figure 4:
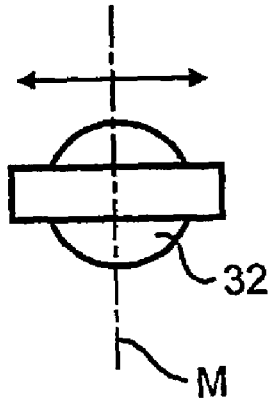

In another embodiment of the construction of the register device 27, it is not arranged pivotable around the pivot axis S, but instead is movable linearly, and, in an advantageous manner, is also movable vertically in respect to the center plane M, in a frame, which is not specifically represented in FIGS. 3 and 4. This applies correspondingly to the embodiments of the register device 27 in accordance with the first and second exemplary embodiments which are FIGS. 1 and 2.

The embodiment of the register device 27 with its own rotatory drive mechanism makes possible, on the one hand, a tension regulation, or at least an improved conveying behavior when conveying the strand 03, 04, and, on the other hand, also makes possible a reversal of the direction of rotation of the register roller or rollers without a large outlay in gear technology.

It is possible, by the use of the device in accordance with the present invention, for example during collecting operations and when utilizing "double-large" printing cylinders, such as when using a forme cylinder that has a circumference corresponding to two standing printed pages and, if necessary, also including non-printing parts, such as fastening devices, etc., to create a product with four books. If there is no collection, or if the forme cylinders merely have a single circumference, two books can be produced. The four or two books can be selectively conducted to one of the two folders 19, 21, or can be split up to both of the two folders 19, 21.

If the device in accordance with the present invention is integrated into a hopper structure 02 with additional hoppers, which are not specifically represented, which hoppers, for example, are arranged as a further double hopper above the hoppers 08, 09, the flexibility, with regard to possible products, is considerably increased. The webs, or the strands 33, coming from these hoppers can be additionally conducted to the folders 19, 21 on a direct path, or via the register device 27. This applies, in particular, if these hoppers and/or their guide devices, are arranged symmetrically with respect to the center plane M.

The embodiment of the register device 27 with two register rollers 28, 29, as seen in FIG. 1, can be used in the situation of further hoppers which are not specifically represented, and which are arranged above the hoppers 08, 09, in particular also for an additional strand 33, or strands 33 as shown in dashed lines in FIG. 1. In case the strands 33 have already been adjusted in their own linear register by their own devices, they can be additionally conducted over one of the rollers 28, 29 to one or both strands 03, 04. However, in a further development of the present invention, the distance "a" between the two rollers 28, 29 can also be embodied to be adjustable, for example by the use of a drive mechanism. In this further embodiment, one or several of the strands 33 coming from above, as shown in dashed lines in FIG. 1 can be conducted over a roller 28 which does not act together with a lower strand 03, 04, and its linear register can be set by setting the distance "a". Then, this strand 33 can be conducted, either together with the lower strands 03, 04 to the same folder 21 or, relative to a further strand 33, a further strand 33 whose linear register has been set, conducted to the folder 19. In this case, the two rollers 28, 29 are without their own drive mechanism, or are each embodied with their own drive motor.

While preferred embodiments of a device for producing folded products, in accordance with the present invention, have been set forth fully and completely hereinabove, it will be apparent to one of skill in the art that various changes in, for example, the type of press used to print the web or webs, the longitudinal cutting devices for the webs and the like, could be made without departing from the true spirit and scope of the present invention which is accordingly to be limited only by the following claims.

What is claimed is:

1. A device for making folded products comprising:

a folding hopper structure;

at least two folding hoppers in said folding hopper structure and adapted to produce at least first and second separate longitudinally folded strands;

a folding unit adapted to receive said at least first and second folded strands from said folding hopper structure; and at least on register device adapted to establish a path of travel between said at least two folding hoppers and said folding unit and wherein said register device is selectively operable in a first mode for engagement with one of said at least first and second longitudinally folded strands and in a second mode for engagement with a different one of said at least first and second longitudinally folded strands whereby said at least first and second longitudinally folded strands are received in said folding unit in longitudinal register.

2. The device of claim 1 wherein said folding unit includes first and second folders for processing said at least first and second longitudinally folded strands, each of said first and second folders including a first folder nip.

3. The device of claim 2 further including a folding hopper nip for each of said at least first and second folding hoppers, said first folder nips for each of said first and second folders being located at substantially identical distances from said respective first and second folding hopper nips.

4. The device of claim 2 wherein said at least two folding hoppers are arranged at a first feed level and said first and second folders are arranged at a second feed level, said first feed level being directly above said second feed level.

5. The device of claim 2 wherein the two strands are conducted selectively separately to each of said first and second folders and combined at one of said first and second folders.

6. The device of claim 1 wherein a spatial location of said register device is changeable.

7. The device of claim 6 further including means supporting said register device for pivotal movement about a pivot axis.

8. The device of claim 1 further including first and second register rollers in said register device, said first and second register rollers being located at a fixed distance from each other.

9. The device of claim 8 further including means for selectively bringing each one of said first and second register rollers into contact with selectively one of said strands, another of said strands, and none of said strands.

10. The device of claim 9 wherein each one of said first and second register rollers engages its respective one of said at least first and second longitudinally folded strands at a location facing away from another one of said strands.

11. A device for making folded products comprising:

a folding hopper structure;

at least two folding hoppers in said folding hopper structure and adapted to produce at least first and second separate longitudinally folded strands;

a folding unit adapted to receive said at least first and second longitudinally folded strands from said folding hopper structure; and at least one register device adapted to establish a path of travel of at least one of the said first and second longitudinally folded strands between said folding hopper structure and said folding unit, said at least one register device being selectively operable in a first mode acting with one of said at least first and second longitudinally folded strands and in a second mode acting with a different one of said at least first and second longitudinally folded strands.

12. The device of claim 11 wherein said folding unit includes first and second folders for processing said at least first and second longitudinally folded strands, each of said first and second folders including a first folder nip.

13. The device of claim 12 further including a folding hopper nip for each of said at least first and second folding hoppers, said first folder nips for each of said first and second folders being located at substantially identical distances from said respective first and second folding hopper nips.

14. The device of claim 12 wherein said at least two folding hoppers are arranged at a first feed level and said first and second folders are arranged at a second feed level, said first feed level being directly above said second feed level.

15. The device of claim 12 wherein the two strands are conducted selectively separately to each of said first and second folders and combined at one of said first and second folders.

* * * * *